US007395737B2

(12) United States Patent
Zhou

(10) Patent No.: US 7,395,737 B2
(45) Date of Patent: Jul. 8, 2008

(54) BOTTLE OPENER

(76) Inventor: Jianhua Zhou, Rm. 401, Apartment 3, Unit 8, Shen Yue Yuan, Gong Shu District, Hangzhou, Zhejiang 310014 (CN)

( * ) Notice: Subject to any disclaimer, the term of this patent is extended or adjusted under 35 U.S.C. 154(b) by 85 days.

(21) Appl. No.: 11/333,248

(22) Filed: Jan. 18, 2006

(65) Prior Publication Data

US 2007/0107555 A1 May 17, 2007

(30) Foreign Application Priority Data

Nov. 16, 2005 (CN) ..... 2005 2 0132296

(51) Int. Cl.
*B67B 7/62* (2006.01)
*B67B 7/00* (2006.01)

(52) U.S. Cl. ..... 81/3.37; 81/3.2; 81/3.39

(58) Field of Classification Search ..... 81/3.37, 81/3.2, 3.33, 3.39, 3.55, 3.08, 3.36; 7/155; D8/18

See application file for complete search history.

(56) References Cited

U.S. PATENT DOCUMENTS

| | | | | | |
|---|---|---|---|---|---|
| 4,729,267 | A * | 3/1988 | Giebeler | ..... | 81/3.37 |
| 4,765,206 | A * | 8/1988 | Poehlmann | ..... | 81/3.37 |
| 5,000,063 | A * | 3/1991 | Federighi, Sr. | ..... | 81/3.37 |
| 5,924,338 | A * | 7/1999 | Peck | ..... | 81/3.37 |
| 5,934,160 | A * | 8/1999 | Gibson | ..... | 81/3.37 |
| 6,073,519 | A | 6/2000 | Eguren | | |
| D430,469 | S * | 9/2000 | Thuma | ..... | D8/42 |
| 6,622,595 | B1 * | 9/2003 | Federighi | ..... | 81/3.48 |
| 6,799,490 | B1 * | 10/2004 | Chu | ..... | 81/3.37 |
| 7,069,813 | B2 * | 7/2006 | Cheung | ..... | 81/3.37 |
| 7,069,825 | B2 * | 7/2006 | Cheung | ..... | 81/337 |
| D533,755 | S * | 12/2006 | Yates, III | ..... | D8/42 |
| 2002/0017167 | A1 * | 2/2002 | Fabbro | ..... | 81/3.37 |

FOREIGN PATENT DOCUMENTS

| | | | |
|---|---|---|---|
| EP | 1 215 165 | A | 6/2002 |
| FR | 2 780 390 | A1 | 12/1999 |
| GB | 2 399 566 | A | 9/2004 |
| WO | WO 2005/023696 | A | 3/2005 |

* cited by examiner

*Primary Examiner*—Alvin J. Grant
(74) *Attorney, Agent, or Firm*—Birch, Stewart, Kolasch & Birch, LLP

(57) ABSTRACT

A bottle opener including a housing with a inner cavity; a pair of clamping handles having upper portions coupled to the lower portions of the housing, and the lower portions including clamping portions configured to mate with the neck of the bottle. Also included are an actuator; a first sliding block making reciprocating movement in a longitudinal axis direction with respect to the inner cavity of the housing by the actuator; a helical screw assembly having an upper portion mounted in the first sliding block by a bearing and a lower portion that is free with rotation related to the first sliding block; and a second sliding block contained only slidably in the inner cavity of housing and positioned between the bottom plane of the inner cavity and the lower surface of the first sliding block.

12 Claims, 6 Drawing Sheets

BOTTLE OPENER

BACKGROUND OF THE INVENTION

1. Field of the Invention

This invention relates to a bottle opener for opening bottle of wine with cork and the like.

2. Description of Related Art

Conventional bottle of wine was stored with cork. While drinking, someone used a bottle opener to pull the cork out. The traditional bottle opener usually comprises a screw. While used, the screw is rotated into the cork, then pulled out with the cork by additional apparatus such as lever. This bottle opener requires too much time and energy.

Patent application WO 2005/023696A1 discloses a bottle opener including a screw mounted on a carrier, wherein the carrier was deposited on a frame. The carrier can move forward and backward along the longitudinal direction and rotates around the central line. A control nut is rotatably mounted on the frame with a inner cavity therethrough matched with the screw. An actuator means operatively connected to the carrier for reciprocate in order to urge the screw in the inner cavity. A first restraint means is provided to control the rotary movement of the screw and a second restraint means was provided to control the rotation of the control nut. A latch means is provided to releasably latch the control nut to the frame to restrain relative movement in the longitudinal axis of the screw. A detent and a recess are separately provided on the first and second restraint means to limit the rotation of the bottle opener.

The above-mentioned bottle opener can extract cork from bottle quickly and easily. However, this type of bottle opener was provided with complicated structure. If the power received on the restraint means and the latch means are not proper, failure may result.

SUMMARY OF THE INVENTION

An object of the present invention is to provide a bottle opener with a simple structure that improves the power receiving elements of the inner structure.

Another object of the present invention is to provide a bottle opener which works reliably with lower rate of failure.

In order to achieve the above-mention objections, the bottle opener provided in the present invention comprises a housing with a inner cavity therethrough; a pair of clamping handles whose upper portion are coupled to the lower portion of the housing and lower portion comprises clamping portions configured to mated with the neck of the bottle; an actuator; a first sliding block making reciprocating movement in longitudinal axis direction with respect to the inner cavity of the housing by the actuator; a helical screw assembly whose upper portion is mounted in the first sliding block by a bearing means and lower portion is free with rotation related to the first sliding block; a second sliding block contained slidably in the inner cavity of housing and positioned between the bottom plane of the inner cavity and the lower surface of the first sliding block, having a screw passage through which screw can't pass unless it rotates; a latch means selectively latching or releasing the second sliding block with respect to the inner cavity in the longitudinal axis direction; a clutch means selectively transferring the driving force of movement in longitudinal axis direction from the first sliding block to the second sliding block. The clutch means is disassembled when the second sliding block is latched, while the second sliding block is released when the clutch means is assembled.

As set out above, the latch means and the clutch means of this invention not only comprise simple structure but also work reliably. This advantage will be described in detail in the following embodiments.

Further, the latch means comprises a pair of latch rods with lower portion articulated to the clamping handle, middle portion including pressed member, and upper portion being latch hooks coupled to latch members of the second sliding block, and a pair of springs urging the latch hooks into the latch members. The clutch means comprises a pair of connection members whose upper portion has a recess for receiving projection of the first sliding block, middle portion is rotatably fixed on two opposite sides of the second sliding block, and a pair of springs installed between the second sliding block and the lower portion of the connection members. It is easy to meet the processing requirement of the elements of latch means and clutch means. Furthermore, as the design is proper, the stress intensity of the bottle opener is guaranteed to prevent damage.

DETAIL DESCRIPTION OF PREFERRED EMBODIMENTS

Figure 1:
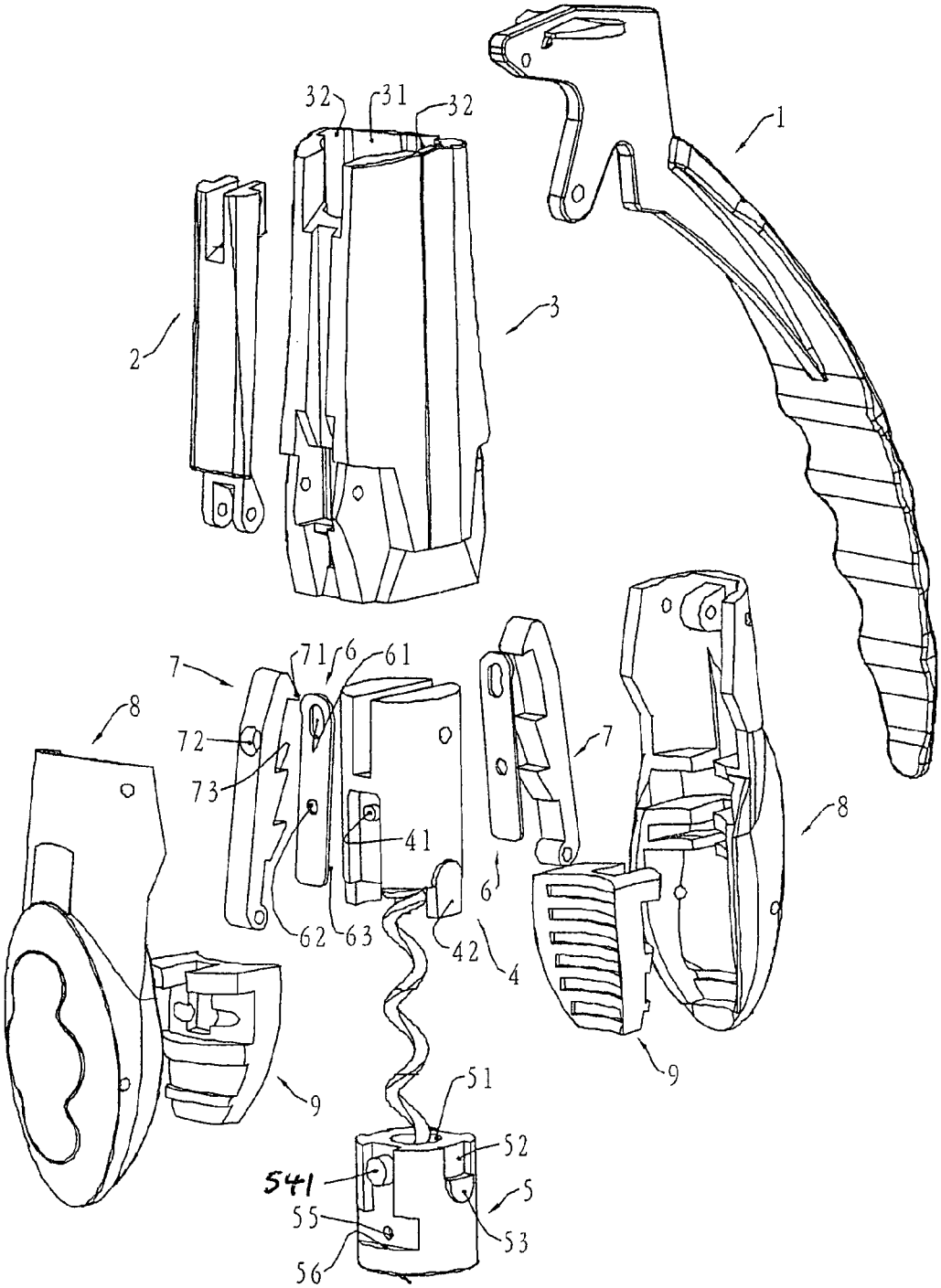
FIG. 1 is a perspective exploded view of a bottle opener according to the preferred embodiment.
Figure 2:
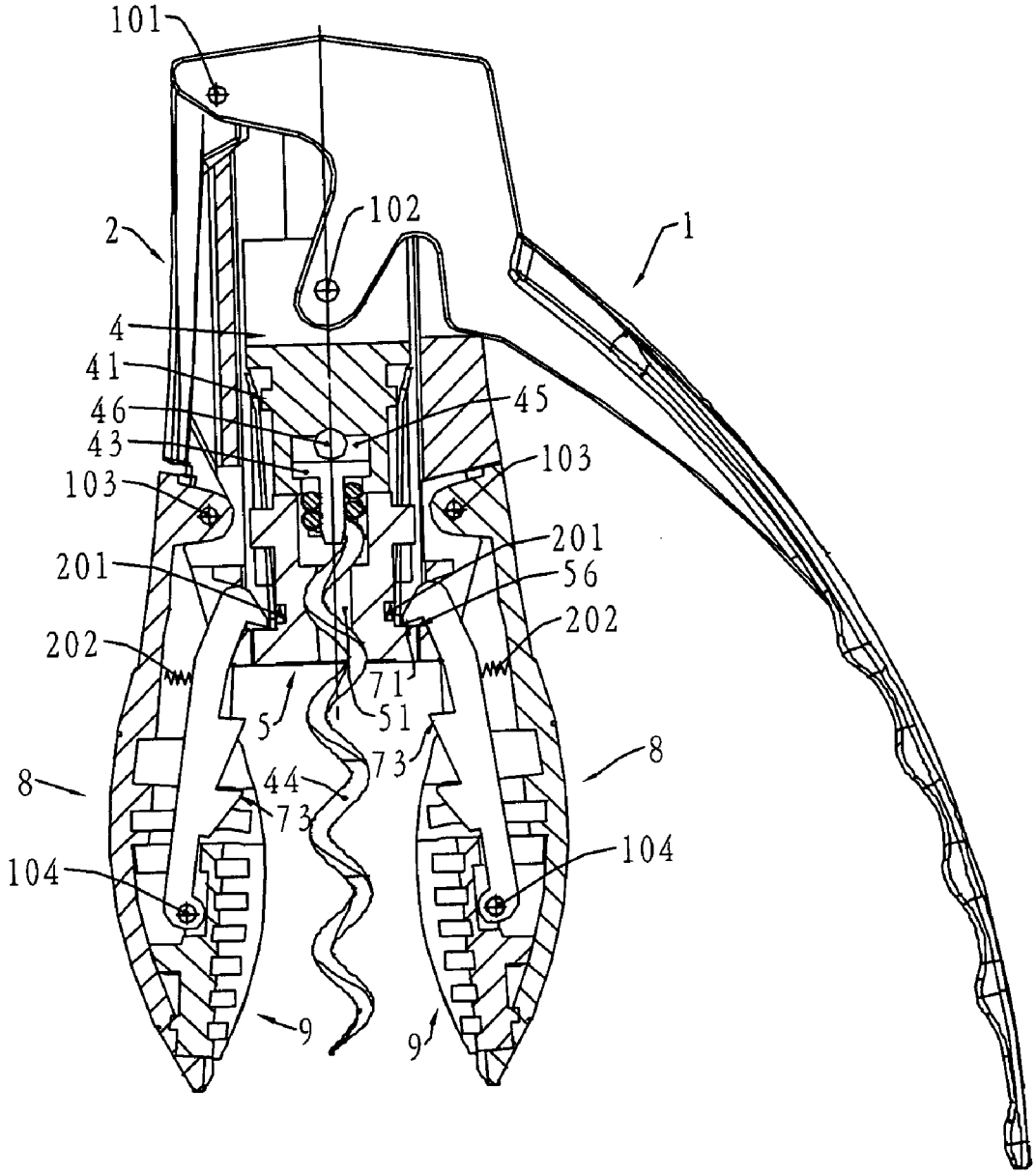
FIG. 2 is a longitudinal cross section view of the preferred embodiment.

Referring to FIG. 1 and FIG. 2, the bottle opener includes a housing 3 in approximately cylinder shape with an inner cavity 31 therethrough. A pair of clamping handles 8 are coupled to the lower portion of the housing 3 by hinges 103 at their upper portions. Two pads 9 are provided on the lower portion of the clamping handles 8, the opposite surfaces of which are defined as the clamping portion. The actuator mainly includes a lever 1 and a link arm 2. The link arm 2 is articulated to the lever 1 by one hinge 101 at its upper portion, and to the lower portion of the housing 3 by another hinge 102 at its lower portion. The hinge 102 also connects the lever 1 to a first sliding block 4. Two guide protrusions 42 are integrated on the outer wall of the first sliding block 4 to mate with a pair of recesses 32 formed on the wall of the inner cavity 31. In this manner, the first sliding block 4 can only move along the longitudinal axis direction in the inner cavity 31. A helical screw assembly includes a screw 44 and a screw seat 43. The screw seat 43 rotates around the central axis of a cavity 45 formed in the first sliding block 4. A ball bearing 46 is positioned between the upper surface of the screw seat 43 and the inner surface of the cavity 45 to form a plane thrust bearing. That is the helical screw assembly (43, 44) rotates with respect to the longitudinal axis direction of the first sliding block 4. A second sliding block 5 is slidably installed along the longitudinal axis direction in the inner cavity 31 with a pair of guide protrusions 53 also coupled with the recess 32. In this manner, the second sliding block 5 can only move along the longitudinal axis direction of inner cavity 31. As the recess 32 does not extend to the bottom, the second sliding block 5 is restrained between the bottom surface of the housing 3 and the lower surface of the first sliding block 4. The second sliding block 5 also comprises a screw passage 51 from which the screw 44 doesn't pass through unless it rotates. Latch means includes a pair of latch rods 7 and a pair of the first springs 202. One of the latch rods 7 includes a lower portion articulated to the clamping handle 8 by one hinge 104, a middle portion including a pressed member 73 and a upper portion defined as a latch hook 71 coupled with the latch member 56 of the second sliding block 5. One end of the first spring 202 is supported against the clamping handle 8, and the other end is mounted in a recess 72 of the latch rod 7. Therefore, the latch hook 71 can be driven into the latch portion 56 by the resilient force. Clutch means comprises a pair of second springs 201 and a pair of rectangle connection members 6. A first hole 61 is provided in the upper portion of the connection member 6, through which the connection member 6 can be fixed on the opposite sides of the second sliding block 5. A second hole 62 is provided in the middle portion of the connection member 6 for receiving a protruded portion 41 formed on the first sliding block 4. A pair of the second springs 201 are respectively supported between the lower portion 63 of the connection member 6 and a cavity 55 formed on the second sliding block 5. Therefore, the lower portion 63 of the connection member 6 is urged away from the second sliding block 5 by the resilient force.

The operation process of the preferred embodiment will now be described. FIG. 2 shows the bottle opener in a normal state. Under this condition, the resilient force of the first spring 202 is stronger than that of the second spring 201. Therefore, if there is no external force applied to the pressed member 73, even the clamping handles 8 are pressed to rotate around the hinge 103 to be closer with each other, the latch hook 71 is still locked to the latch member 56 in latch state. At the same time, the first spring 202 and the lower portion 63 of connection member 6 are pressed so that the hole 61 in the upper portion of the connection member 6 is separated from the protruded portion 41. Under this condition, the clutch means is in the separate state.

Figure 3:
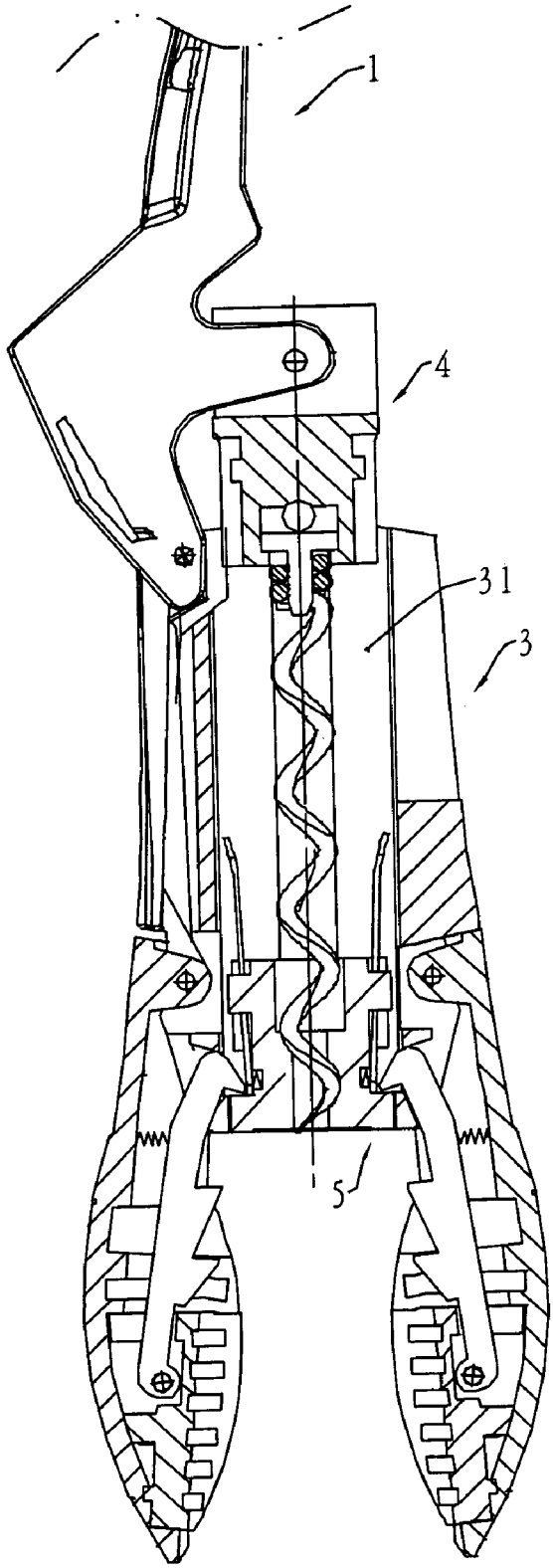
FIG. 3 is a longitudinal cross section view of the preferred embodiment showing the screw is ready for being rotated into the cork.

FIG. 3 shows how the cork will be pulled out of the bottle. The first sliding block 4 slides upwardly in the inner cavity of the housing 3 by turning the lever 1 upwardly. As the clutch means is in separate state and the latch means is in latch state, the second sliding block 5 is standing in the housing 3, and the helical screw assembly rotates back to the inner cavity 31 of the housing 3.

Figure 4:
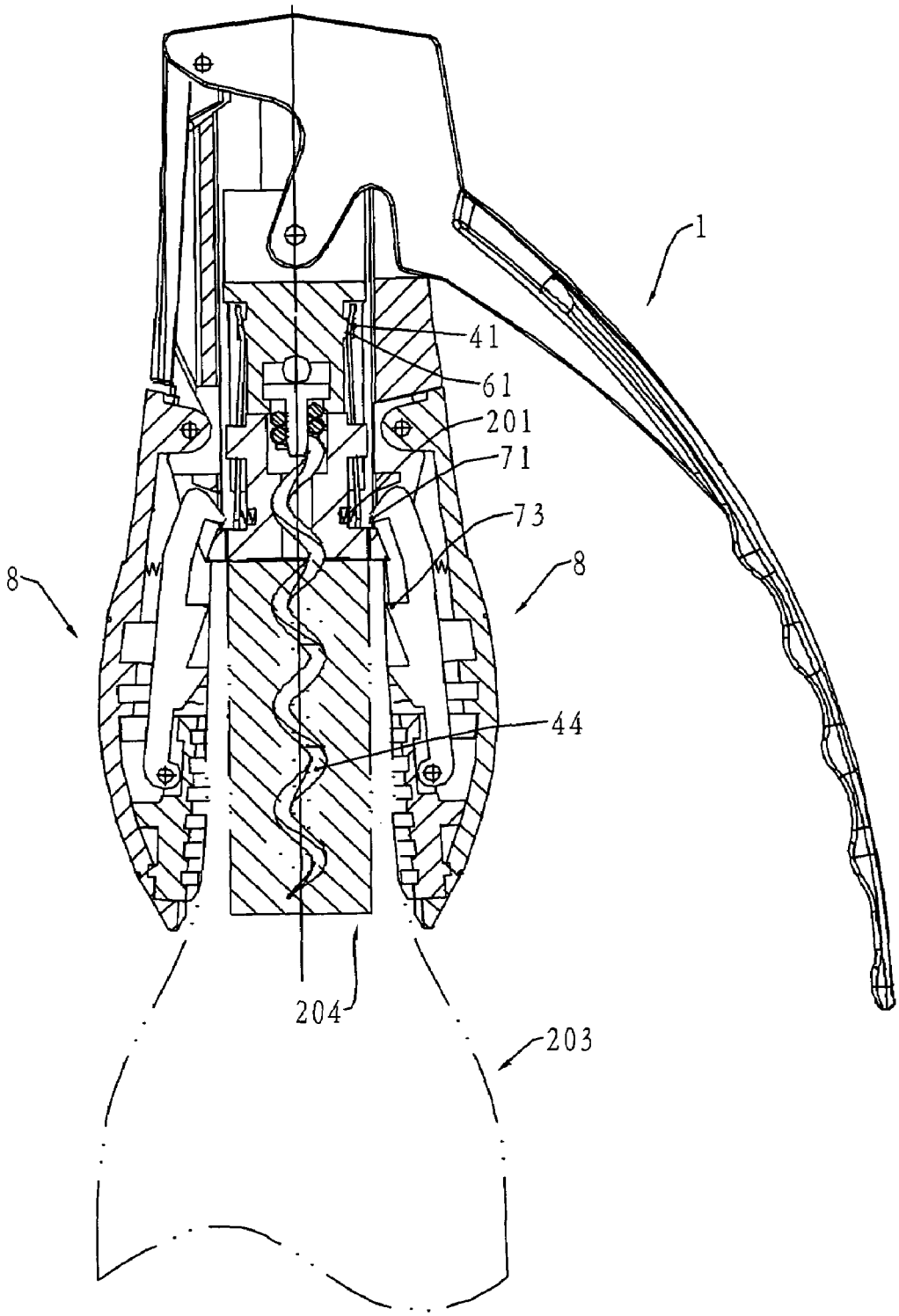
FIG. 4 is a longitudinal cross section view of the preferred embodiment showing the screw has been rotated into the cork.
Figure 5:
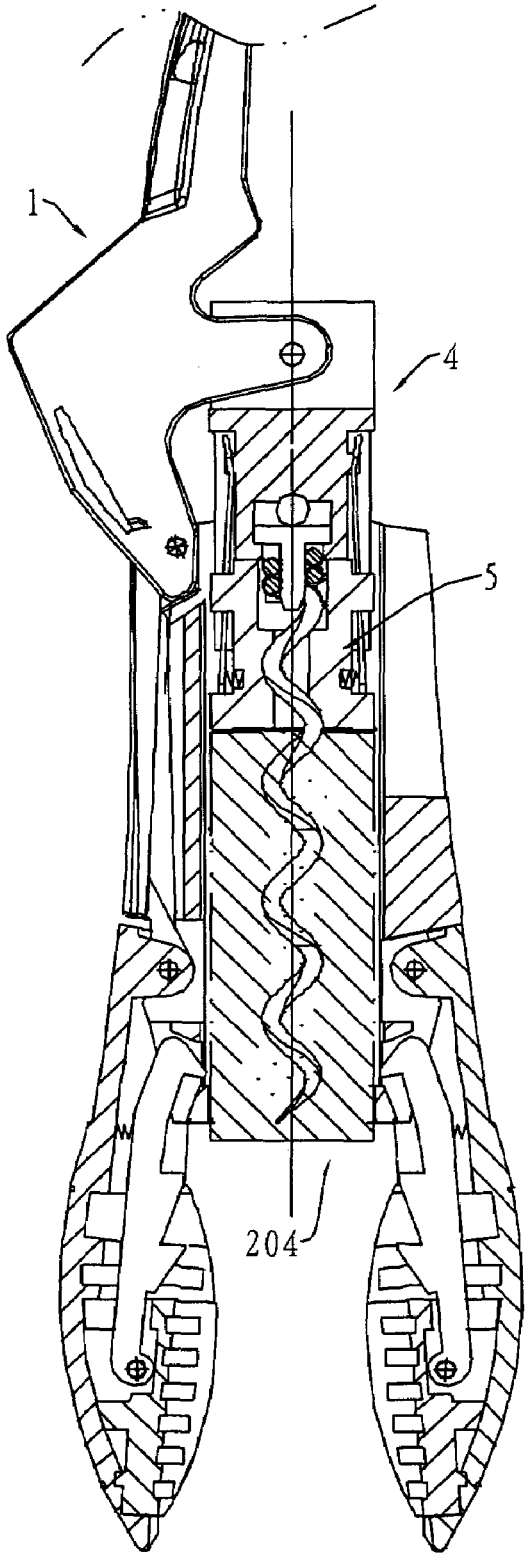
FIG. 5 is a longitudinal cross section view of the preferred embodiment showing the cork has been pull out of the bottle.

While the neck portion of the bottle 203 is grasped by the two clamping handles 8, it will press against the pair of latch rods 7 to overcome the resilient force of the first spring 202 to release the latch hook 71 away from latch member 56. The lever 1 is then pressed downwardly to urge the screw 44 rotating through the screw passage 51 of the second sliding block 5 into the cork 204 as shown in FIG. 4. As the bottle 203 and the cork 204 do not belong to the invention, they are presented as dash double-dot. As previously mentioned, the latch means is released so that the hole 61 will be engaged with the protruded portion 41 by the second spring 201. It is said that the first sliding block 4 and the second sliding block 5 are coupled via the clutch means. In the meantime, the lever 1 is turned upwardly to lead the first sliding block 4 together with second sliding block 5 move upwardly. As the screw 44 has lost the rotating power, it will extract the cork 204 out from the bottle 203 while moving upwardly. Both the screw 44 and the cork 204 are housed in the inner cavity 31, which is shown in FIG. 5. Now, the bottle is open.

Then the cork 204 will be discarded. First, move the lever 1 downwardly again as shown in FIG. 2. As the pressed member 73 is no longer pressed by the bottle 203, the latch means will go back to the latch state by the resilient force. The clutch means is under the separate state again. Second, turn the lever 1 upwardly again, and then the screw 44 will rotate upwardly out of the cork 204 which is blocked by the second sliding block 5.

Figure 6:
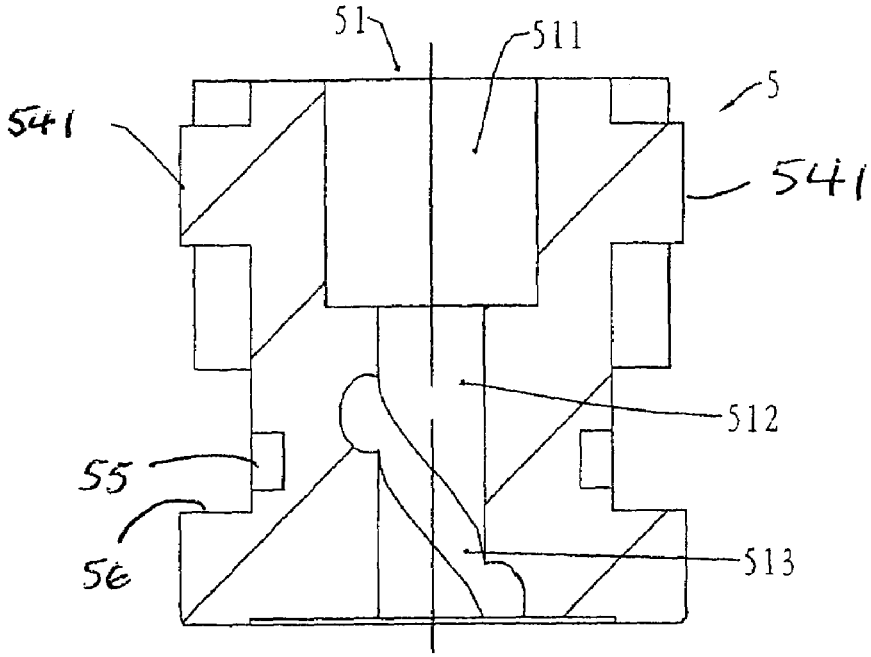
FIG. 6 is a longitudinal cross section view of the second sliding block of the preferred embodiment.

Referring now to FIG. 6, in the preferred embodiment, the screw 44 is in constant pitch, and the screw passage 51 of the second sliding block 5 includes three regions in longitudinal axis direction. The first region 511 and the second region 512 are holes. Compared to the outer diameter of the screw, the diameter of the first region 511 is slightly larger, while that of the second region 512 is smaller. Bosses 541 projecting radially from sides of the second sliding block 5 for mating with holes 6 of connection member 6. The third region 513 has a passage wall matching with the outer surface of the screw. The screw must rotate to pass through the hole 51 serving as the screw passage.

Figure 7:
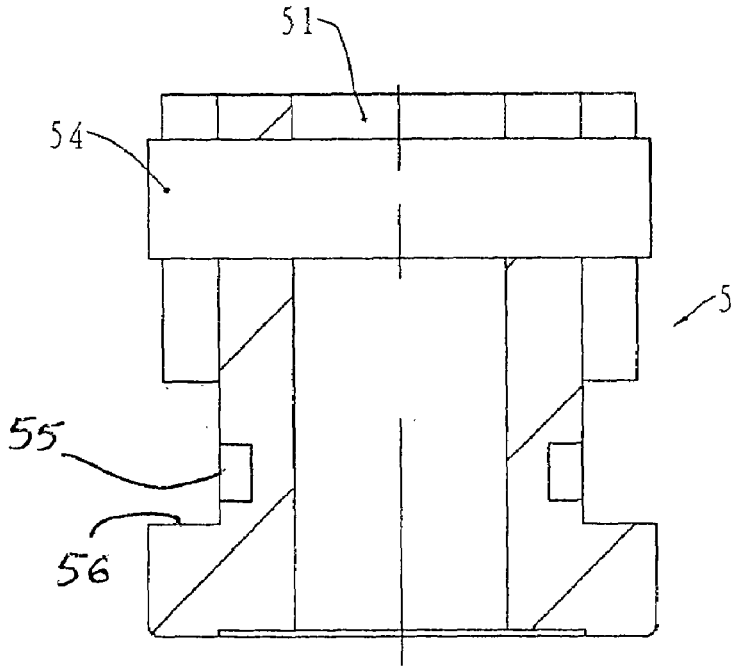
FIG. 7 is a longitudinal cross section view of the second sliding block of another embodiment.

Moreover, there are other embodiments according to the main idea of this invention. FIG. 7 shows another construction of the second sliding block 5. The screw passage 51 has a diameter slightly larger than that of the screw 44 profile to ensure that the screw 44 is able to pass therethrough. A pole 54 extends in a radial direction through the second sliding block 5 and is fixed inside the screw passage 51 with two ends extending out of the wall of the second sliding block 5 for mating with two holes 61. The pole 54 performs the same function as a clutch. The inside parts of the pole 54 causes the screw to rotate only through the screw passage 51. A circle-shaped cross-section of pole 54 is preferred. Obviously, the manufacture technology of this embodiment is simple.

The above-mentioned embodiments are considered as illustrative only of principles of the invention, and non-limiting examples. The invention is of course susceptible of numerous modifications and variations, all of which are within the scope of the appended claims. For example, in order to achieve the function that both of the first and second sliding block can only move in longitudinal axis direction, the cross-section of the inner cavity of the housing and the cross-section of the first and second sliding block can be designed to non-circular. The latch means and the clutch means can be simplified as a rod and a connection member. In a similar way, a pair of clamping handles 8 can be simplified, having one that is fixed while the other is pivot to the housing. A simple construction, reasonable pressed state, and a low failure rate are the advantage of this invention.

What is claimed is:

1. A bottle opener, comprising:

a housing having an inner cavity extending therethrough;

a pair of clamping handles, each having an upper portion and a lower portion, wherein each of the upper portions is pivoted to a lower part of said housing, and each of the lower portions includes a clamping part mated with the neck of a bottle;

an actuator;

a first sliding block movable in a longitudinal direction with respect to the inner cavity of said housing;

a helical screw assembly, wherein an upper portion of the screw assembly has been changed in said first sliding block by a bearing member; and a second sliding block slidably mounted in said inner cavity along the longitudinal direction and restrained between a bottom plane of said inner cavity and a lower surface of said first sliding block, wherein said second sliding block includes a screw passage therethrough adapted to receive said helical screw;

latch means having a pair of first springs adapted to selectively latch said second sliding block; and clutch means adapted to transfer a driving force of longitudinal movement from said first sliding block to said second sliding block, wherein said clutch means includes a pair of connection members and a pair of second springs, wherein each of said connection members respectively includes an upper portion having a hole for receiving a raised portion of said first sliding block, a middle portion rotatably installed on two opposite sides of said second sliding block, the middle portion having a hole for receiving a boss extending radially from each side of the second sliding block, wherein the second springs are respectively installed between said second sliding block and lower portions of said connection member, wherein the first hole receiving the raised portion of the first sliding block located at the upper porton of the connection member is spaced from the second hole receiving the boss from the second sliding block, the second hole being spaced from the lower portion of the connection block securing the second spring thereby placing the second hole between the first hole and the spring wherein said second sliding block is locked while said clutch means is under a separate state and said second sliding block is released while the clutch means is under an assembled state.

2. The bottle opener according to claim 1, wherein said latch means includes a pair of latch rods and said pair of first springs, wherein each of the latch rods respectively includes a lower portion pivotably connected to said clamping handle, a middle portion including a pressed member and an upper portion forming a latch hook coupled to a latch member formed on said second sliding block, wherein each of said first springs respectively biases said latch hook into engagement with said latch member with said latch member.

3. The bottle opener according to claim 1, wherein said bearing member is a plane thrust bearing.

4. The bottle opener according to claim 3, wherein said plane thrust bearing is a ball installed between a top wall of a screw seat and a top wall of an inner cavity of said first sliding block.

5. The bottle opener according to claim 1, wherein said helical screw has a constant pitch, and said screw passage of the second sliding block has at least a part coupled with a circumferential surface of said helical screw.

6. A bottle opener, comprising:

a housing having an inner cavity extending therethrough;

a pair of clamping handles, each having an upper portion and a lower portion, wherein each of the upper portions is pivoted to a lower part of said housing, and each of the lower portions includes a clamping part mated with the neck of a bottle;

an actuator;

a first sliding block movable in a longitudinal direction with respect to the inner cavity of said housing;

a helical screw assembly, wherein an upper portion of the screw assembly is fixed in said first sliding block by a bearing member; and a second sliding block slidably mounted in said inner cavity along the longitudinal direction and restrained between a bottom plane of said inner cavity and the lower surface of said first sliding block, wherein said second sliding block includes a screw passage therethrough adapted to receive said helical screw;

latch means having a pair of first springs adapted to selectively latch said second sliding block; and clutch means adapted to transfer a driving force of longitudinal movement from said first sliding block to said second sliding block, wherein said clutch means includes a pair of connection members and a pair of second springs, wherein each of said connection members respectively includes an upper portion having a hole for receiving a raised portion of said first sliding block, a middle portion rotatably installed on two opposite sides of said second sliding block, each of the middle portions having a hole for receiving an end of a pole extending radially from side-to-side through the second sliding block, wherein the second springs are respectively installed between said second sliding block and the lower portions of said connection member, wherein said second sliding block is locked while said clutch means is under a separate state and said second sliding block is released while the clutch means is under an assembled state.

7. The bottle opener according to claim 6, wherein said latch means includes a pair of latch rods and said pair of first springs, wherein each of the latch rods respectively includes a lower portion pivotably connected to said clamping handle, a middle portion including a pressed member and an upper portion forming a latch hook coupled to a latch member formed on said second sliding block, wherein each of said first springs respectively biases said latch hook into engagement with said latch member.

8. The bottle opener according to claim 6, wherein said bearing member is a plane thrust bearing.

9. The bottle opener according to claim 8, wherein said plane thrust bearing is a ball installed between a top wall of a screw seat and a top wall of an inner cavity of said first sliding block.

10. The bottle opener according to claim 6, wherein said helical screw has a constant pitch, and said screw passage of the second sliding block has at least a part coupled with a circumferential surface of said helical screw.

11. The bottle opener according to claim 6, wherein said screw passage of the second sliding block is a through hole extending axially therethrough and has a diameter that is larger than a diameter of said helical screw.

12. The bottle opener according to claim 6, wherein the pole extending in the radial direction from side-to-side through the second sliding block has a diameter approximately 1 to 2 times larger than of a diameter of said helical screw.

* * * * *